US011118881B2

(12) United States Patent
Roper et al.

(10) Patent No.: US 11,118,881 B2
(45) Date of Patent: Sep. 14, 2021

(54) ELECTRIC IR ILLUMINATION

(71) Applicant: BAE SYSTEMS plc, London (GB)

(72) Inventors: Mark Edward Roper, USK (GB); Martyn John Hucker, USK (GB)

(73) Assignee: BAE SYSTEMS plc, London (GB)

( * ) Notice: Subject to any disclaimer, the term of this patent is extended or adjusted under 35 U.S.C. 154(b) by 30 days.

(21) Appl. No.: 16/485,227

(22) PCT Filed: Nov. 13, 2017

(86) PCT No.: PCT/GB2017/053417

§ 371 (c)(1),
(2) Date: Aug. 12, 2019

(87) PCT Pub. No.: WO2018/091874

PCT Pub. Date: May 24, 2018

(65) Prior Publication Data

US 2020/0056867 A1 Feb. 20, 2020

(30) Foreign Application Priority Data

| | | |
|---|---|---|
| Nov. 15, 2016 | (GB) | 1619313 |
| Jan. 12, 2017 | (EP) | 17151164 |
| May 9, 2017 | (EP) | 17275064 |
| May 9, 2017 | (GB) | 1707421 |

(51) Int. Cl.
*F42B 12/42* (2006.01)
*F42B 12/38* (2006.01)

(52) U.S. Cl.
CPC ..... *F42B 12/42* (2013.01); *F42B 12/38* (2013.01)

(58) Field of Classification Search
None
See application file for complete search history.

(56) References Cited

U.S. PATENT DOCUMENTS

| | | | | |
|---|---|---|---|---|
| 4,934,273 | A | 6/1990 | Endriz | |
| 7,441,505 | B1 | 10/2008 | Rodgers, Jr. | |
| 7,900,619 | B1 | 3/2011 | Palmer et al. | |
| 2005/0034627 | A1 | 2/2005 | Manole et al. | |
| 2005/0065579 | A1* | 3/2005 | Chen | A61N 5/0616 607/88 |
| 2010/0288885 | A1 | 11/2010 | Munzner | |
| 2012/0044710 | A1 | 2/2012 | Jones | |

(Continued)

FOREIGN PATENT DOCUMENTS

WO 2018091874 A1 5/2018

OTHER PUBLICATIONS

International Search Report and Written Opinion received for PCT Application No. PCT/GB2017/053417. dated Feb. 15, 2018. 16 pages.

(Continued)

*Primary Examiner* — Reginald S Tillman, Jr.
(74) *Attorney, Agent, or Firm* — Finch & Maloney PLLC

(57) ABSTRACT

There is disclosed an IR illumination device and munitions comprising the same. There is provided an IR illumination munition device for selective activation where upon activation the device emits IR radiation in the range of wavelengths of from 750 nm to 900 nm, the device comprising: an electrical power source; an array of IR light emitting diodes to emit the IR radiation.

20 Claims, 4 Drawing Sheets

(56) References Cited

U.S. PATENT DOCUMENTS

2019/0309914 A1* 10/2019 Blair ..... F21L 4/08

OTHER PUBLICATIONS

Extended European Search Report received for EP Application No. 17275064.8, dated Aug. 3, 2017. 8 pages.
GB Search Report under Section 17(5) received for GB Application No. 1707421 2, dated Sep. 27, 2017. 3 pages.
Task, H.Lee, Ph.D, "Night Vision Devices and Characteristics," Visual Problems in Night Operations, Advisory Group for Aerospace Research and Development. (NTIS No. AGARD-LS-187). 1992. 13 pages.

* cited by examiner

ELECTRIC IR ILLUMINATION

FIELD

The present invention relates to an IR illumination device and munitions comprising the same.

BACKGROUND

Conventional IR (dark) illumination flares are typically illumination hand held rockets, which contain a cool burning flare. The flare compositions are pyrotechnic compositions which undergo chemical reactions, typically combustion. Whilst every effort is made to reduce light output in the visible region, due to the nature of the reaction, some visible light output is usually observed, and there may be smoke or other debris that are visible.

SUMMARY

According to a first aspect of present invention there is provided an IR illumination munition device for selective activation where upon activation the device emits IR radiation in the range of wavelengths of from 600 nm to 900 nm, the device comprising: an electrical power source and an array of IR light emitting diodes (IR LEDs), to emit the IR radiation.

Preferably, there is a plurality of light emission units each connected to the electrical power source independently and said light emission units comprise the array of IR light emitting diodes (IR LEDs), and a power converter unit for driving the array.

The device optionally further comprising an operator interface, a control unit independently connected to each light emission unit, the control unit comprising a processor and being operably connected to the operator interface.

In a preferred arrangement, there is provided an IR illumination munition device for selective activation where upon activation the device emits IR radiation in the range of wavelengths of from 750 nm to 900 nm, the device comprising:

an electrical power source;

a plurality of light emission units each connected to the power source independently and said light emission units comprising:

an array of IR light emitting diodes (IR LEDs), to emit the IR radiation;

a power converter unit for driving the array.

Further, the independent coupling of the control unit to each light emission unit, and the provision of a power converter at each light emission unit, tends to provide the device with redundancy in case a part fails in service.

The use of an IR LED, an IR light emitting diode, allows for a light source which is not the product of a pyrotechnic reaction. Pyrotechnic compositions are hazardous, which introduces logistics problems of storage and handling.

A yet further issue is that due to decomposition of the pyrotechnic material in conventional IR flares, often due to moisture ingress, the conventional pyrotechnic IR compositions may have a finite lifetime.

The IR LED may be selected to provide very specific wavelengths, with narrow bandwidths. They have very low power consumption and may be easily integrated onto printed circuits as parts of larger systems.

The range of wavelengths may be independently selected in the near IR, mid IR or Far IR wavelength range. In one arrangement there is provided a first IR LED with a first IR radiation wavelength, and a second IR LED with a second different IR radiation wavelength.

In a further arrangement the array may comprises at least two different wavelength IR light emitting diodes. The IR light emitting diodes may be specifically selected to provide specific wavelengths to work with specific night vision optics. The array and therefore specific IR light emitting diodes may be selectively activated depending on the specific requirement.

The array may be any shape or arrangement, such as for example the IR LEDs may be arranged linearly, random, helical, curved, patterned, within the device. The IR LEDs may be located on the surface or in recessed portions in a housing, to provide protection.

The IR LEDs may be further covered with a layer, coating or sheath to provide protection and/or ruggedness.

Each light emission unit may comprise a capacitive energy store and/or and inductive energy store. Such an energy store may be tuned to deliver power in a particularly responsive manner and so can therefore permit higher switching frequencies of the light emitting element arrays.

There may be provided a capacitor charging means electrically interposed between the power source and each capacitive energy store. The capacitor charging means may be connected to the control unit.

The control unit may be configured for driving at least one of the arrays of light emitting elements in a pulse mode when the device is activated such that in operation the array of light emitting elements may switch between a high power output condition and a low power output condition repeatedly. The pulse mode may be such that the array of light emitting elements may switch between conditions at a predetermined frequency. The low power output mode may be substantially zero watts.

Each array of IR LEDs may comprise at least 5, preferably more than 10, preferably more than 20 IR LEDs.

The power source may be any electrical power source, such as for example an electrical cell, fuel cell, capacitor, preferably a lithium ion battery.

The device may be a hand thrown device, such as a grenade. The device may form part of a munition, such as for example a controlled descent payload capable of being launched from a munition. The device may be attached to or form an integral part of a UAV. The device may form part of an applique for attachment to a body or vehicle.

According to a further aspect of the invention there is provided an IR illumination munition comprising a carrier, a fuze, a controlled descent payload, wherein the payload comprises a device as defined herein.

The operator interface may be configured to enable selection between initiation modes. The initiation modes may comprise any combination of: an instant initiation, a delayed initiation, a wirelessly controlled initiation, such as for example, RF, NFC, Bluetooth, or mechanical force, such as, for example from high-g forces from set-back or high spin rates, which are well known in the art. For launched munitions, such as mortar, shells our under gun launched grenades, the munition may comprise a fuze, which may be set to determine the point of deployment of the payload comprising the device.

The operator interface may be configured to enable selection between activation modes. The activation modes may comprise: a pulse mode where the IR light emitting elements may switch between a high power output condition and a low power output condition repeatedly or a continuous power output mode where the power output is substantially constant. The pulse output may be used to provide a signal or basic communications, instructions.

The device may also further comprise at least one LED or an array of LEDs whose output is outside of the near IR and far IR regions, such as for example the visible light region or UV.

So that the invention may be well understood, embodiments thereof shall now be described with reference to the following figures, of which:

DETAILED DESCRIPTION

Figure 1:
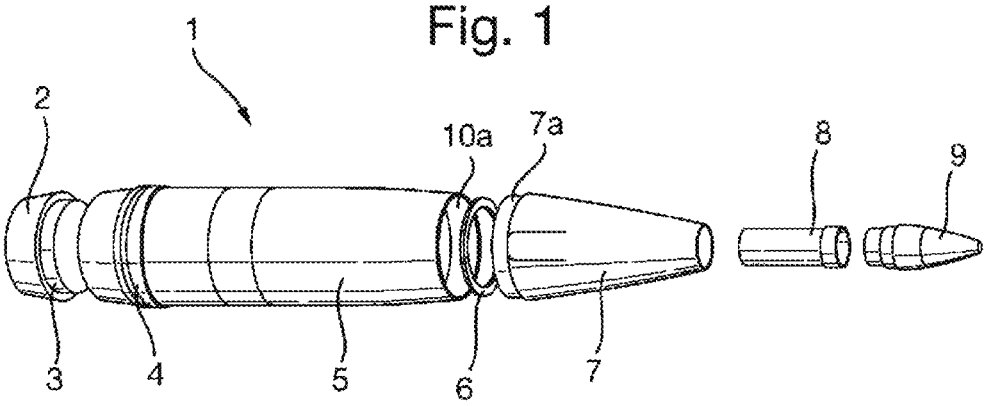
FIG. 1 show an exploded side view of a shell comprising a device according to the invention.

Turning to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The illumination payload device 100 (see FIG. 2), when located in the payload cavity 10*a*, inside the main body, is retained in place by use of a locking ring 6, which screws into the forward end of main body 5. The frangible ogive element 7 has a frangible link 7*a*, in the form of an aluminium thread. The frangible ogive element 7 may be secured to the locking ring 6 or directly to the main body 5. The frangible ogive element receives the expulsion charge 8 and fuze 9. Upon operation of the fuze 9, the expulsion charge 8 builds up pressure within the frangible ogive element and at the bursting pressure the thread 3 shears and the illumination payload device 100 is expelled from the aft of the main body 5.

Figure 2:
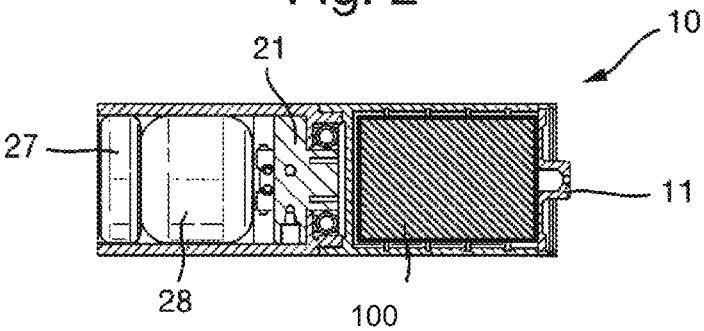
FIG. 2 shows a cross section of the illumination payload device

FIG. 2 shows a modular illumination unit 10, comprising the illumination payload assembly 100, with an electronic switch(or receiver for remote control) 11. The switch after a predetermined period activates the device 29 (shown as 100 in FIG. 6). When the payload 100 is ejected the drogue parachute 27 functions and the parachute delay device 21 causes the main parachute 28 to be deployed.

Figure 3:
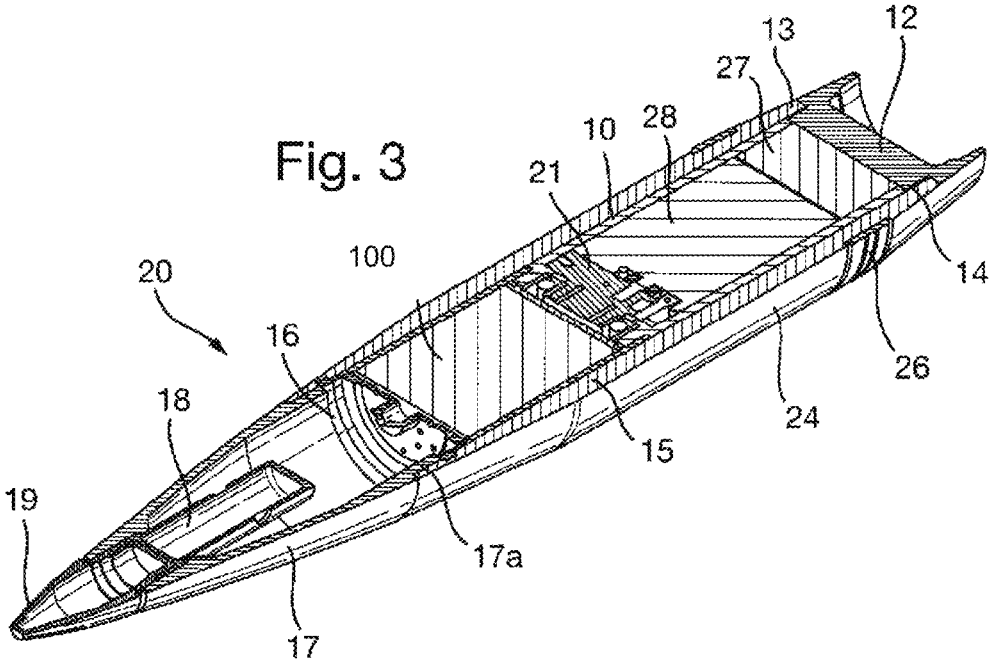
FIG. 3 shows a cross section along the axis of the shell in FIG. 1

FIG. 3 shows an illumination shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The illumination payload device 100 is located in the payload cavity 15, and is retained in place by use of a locking ring 16, which screws into the forward end of main body 24.

The frangible ogive element 17 has a frangible link 17*a*, in the form of an aluminium thread, which is fastened to the locking ring 16. The frangible ogive element receives the expulsion charge 18 and fuze 19. Upon operation of the fuze 19, the expulsion charge 18 builds up pressure within the frangible ogive element and at the bursting pressure the thread 13 shears and the illumination payload device 100 is expelled from the aft of the main body 24.

The illumination payload device 100 is a modular illumination unit 10, which slides into the payload cavity 15.

Figure 4:
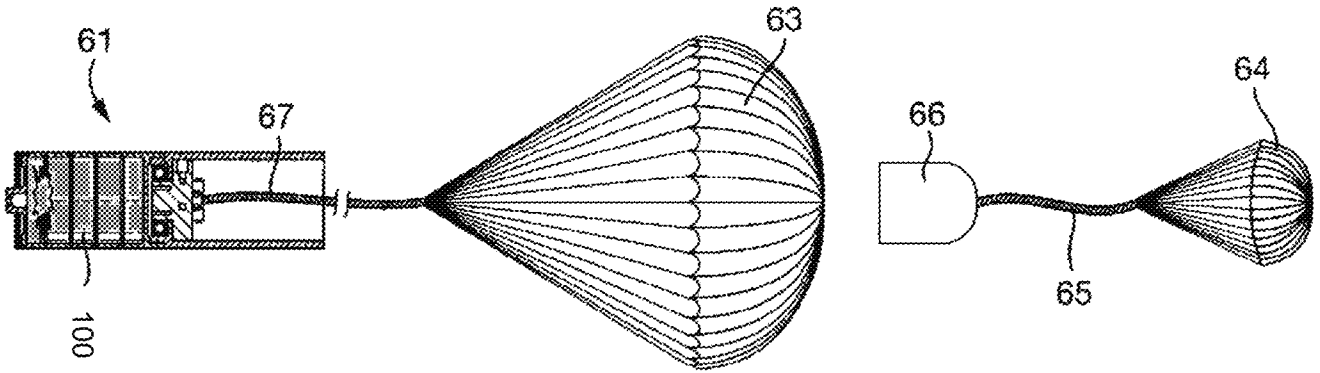
FIG. 4 shows the release sequence of the main parachute

FIG. 4 shows a drogue parachute 64 attached to the main parachute carrier 66 by the carrier tether 65. The drogue parachute 64 is then discarded. The main parachute 63 remains attached to the payload apparatus 61, by means of the payload tether 67, and the illumination payload device 100 is activated.

Figure 5:
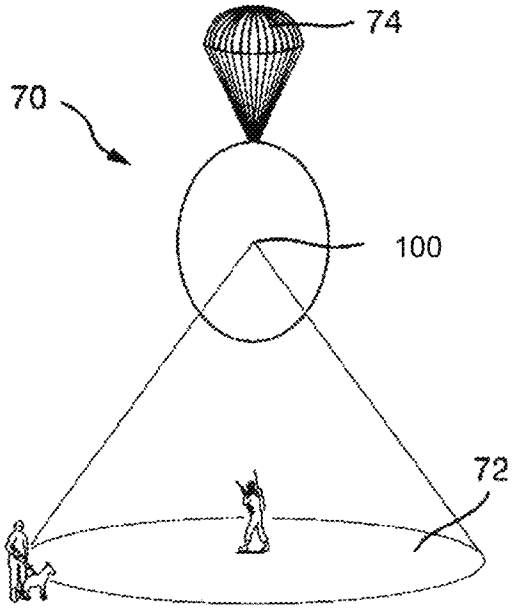
FIG. 5 shows the deployed and activated illumination device.

FIG. 5, shows the controlled descent 70 of the illumination payload device 100, under the control of the main parachute 74. The device during its descent illuminates 72 the target area of interest with IR LEDS, whilst ensuring that the payload device 100 remains intact and under the control of the main parachute, such that it mitigates against collateral damage.

Figure 6:
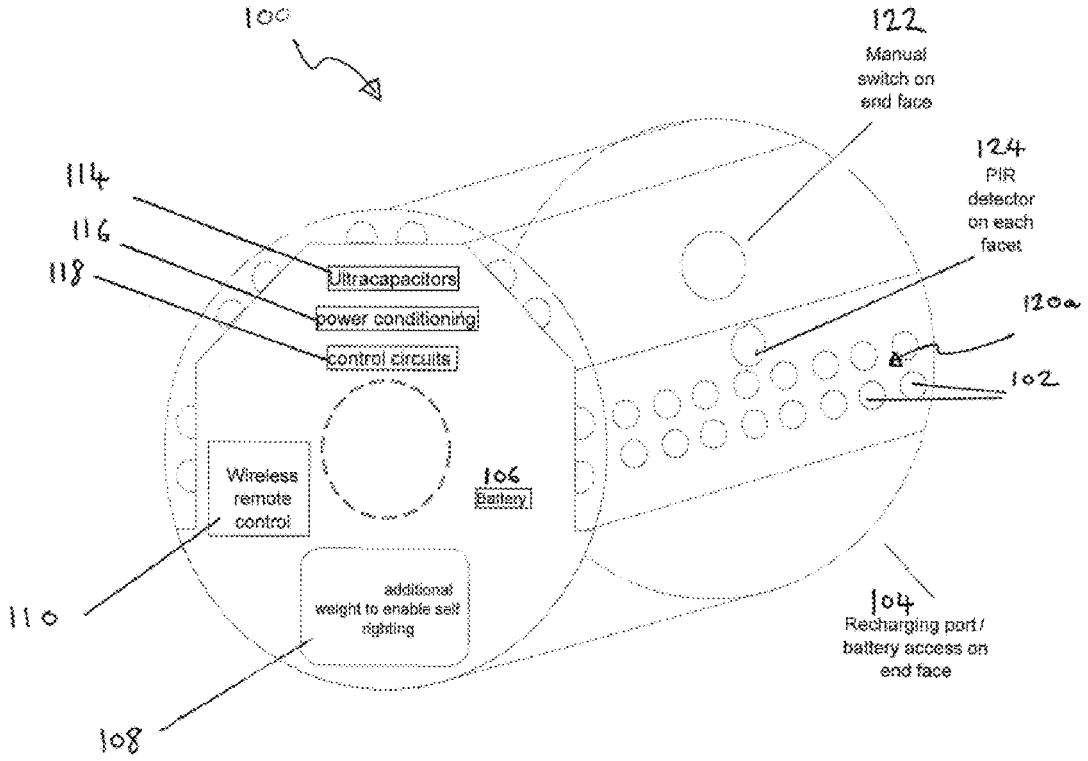
FIG. 6 shows a three-dimensional representation of a device according to the present invention.

With reference to FIG. 6 there is shown generally at 100 a handheld device. The device 100 comprises a substantially cylindrical housing 130 which accommodates a plurality of IR LEDs 102 arranged as IR LED arrays 120*a*, 120*b*. The housing 130 further accommodates a power source 106, a means for adjusting its standing position 108, a transceiver 110 for wireless control of the device, an array of ultracapacitors 114 (which may be arranged as a plurality of arrays), a power converter unit 116 (which may be arranged as a plurality of converter units) for driving the IR LEDs, and a control unit 118.

The housing 130 has a substantially circular front and back face which are substantially parallel and separated by an interconnecting side wall surface. Incorporated into the interconnecting side wall, the housing 130 has facets arranged to extend axially between the substantially circular faces of the cylindrical housing 130. Each of these facets has arranged at it an array of IR LEDs, such as IR LED array 120*a*. Further, each facet is provided with a PIR sensor 124.

A manual switch 122 is provided at the back face of the housing for selectively switching the device 100 between and 'on' mode (where the device 100 may emit IR light if so instructed) and an 'off' mode (where the device 100 may not emit light).

Also provided at the back face of the housing 130 is an access panel or port 104 whereby either the power source 106 can be removed (and replaced), or a recharging energy source can be coupled into the source 106 to recharge it.

In operation, the handheld device 100 may be picked up by an operator, switched manually from the 'off' mode to the 'on' mode using switch 122 and subsequently thrown into an environment. A subsequent instruction received from the wireless transceiver 110 (which may be delivered by a remote control retained by the operator) causes the battery 106 to transfer energy, via the power converter units 116 and/or ultracapacitors 114 to the IR LED arrays 120*a* and 120*b*, which then emit IR light to illuminate a scene proximate to the device 100.

Figure 7:
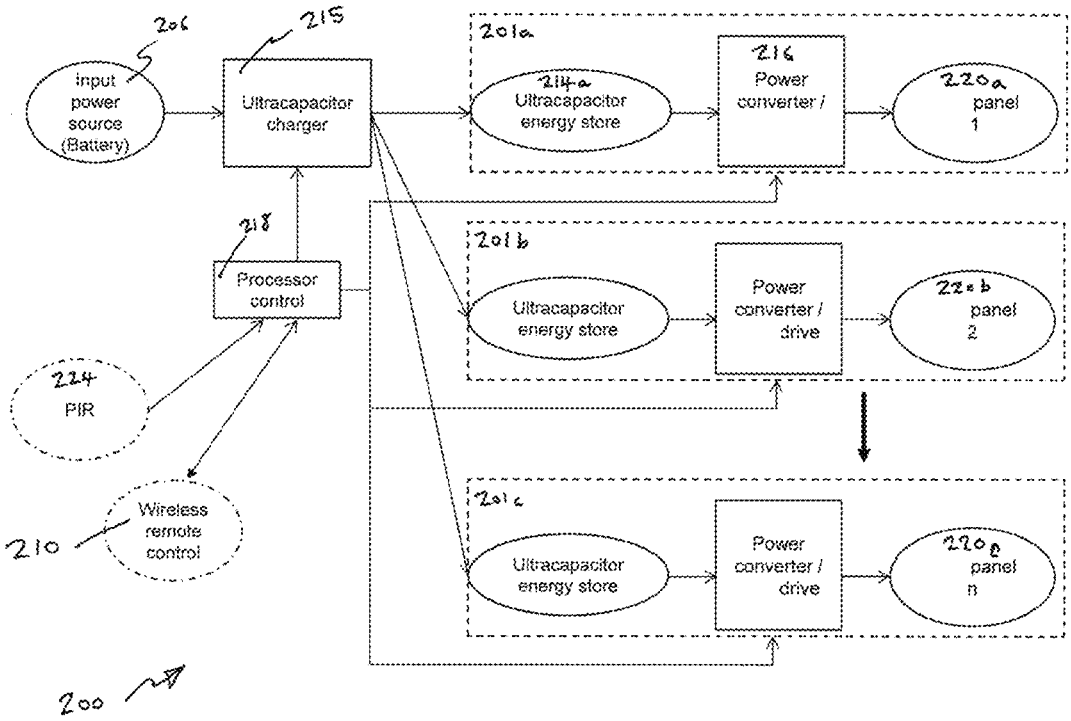
FIG. 7 shows a schematic diagram of a first embodiment of a device according to the present invention.

FIG. 7 shows schematically a device 200, similar to device 100, where components similar to components in device 100 are incremented by 100. For instance the IR LED array 120*a* of the device 100 in FIG. 6 is similar to the IR LED array 220*a* of device 200.

With reference to FIG. 7, there is shown a device 200 provided with a plurality of IR light emission units 201. Each of the light IR emission units 201 comprises an ultracapacitor array 214, a power converter unit 216 and the IR LED array 220. The ultracapacitor array 214 is connected to the power converter unit 216 which is in turn connected to the IR LED array 220.

For instance, an IR light emission unit 201*a* comprises ultracapacitor array 214*a*, connected to power converter unit 216*a* connected to IR LED array 220*a*.

The device 200 is further provided with an ultracapacitor charger 215 connected to each of the arrays of ultracapacitors 214*a*, 214*b* and 214*c*. The ultracapacitor charger 215 is connected to a power source 206 such that the ultracapacitor charger 215 can receive and manage power from the source 206. The ultracapacitor charger 215 is further connected to a control unit 218 such that it may send and receive signals from the control unit 218.

The control unit 218 is additionally connected to each of the power converter units 216*a*, 216*b* and 216*c* such that it can send and receive signals to and from these units.

Still further, the control unit 218 is connected to various interface units, such as a PIR sensor unit 224 and a wireless control unit 210 (which may be provided as part of a broader operator interface including also a manual remote control unit) such that the control unit 218 may act in dependence on signals received from these.

The control unit 218 comprises a signal generator (not shown) and/or clock for generating a periodic signal that varies between an upper value and a lower value at a predetermined frequency.

Each ultracapacitor array 214*a*, 214*b*, and 214*c* is driven by the ultracapacitor charger 215, under instruction from the control unit 218 such that the charging of the ultracapacitor array is regulated such that should the IR LED array need activation at a predetermined time, the ultracapacitor array is able to discharge through the power converter unit 216 into the IR LED array 220 (and thereby put the device 200 is a high power output mode) in a predetermined manner.

In particular the ultracapacitor arrays may be driven to charge during one phase of a cycle of the periodic signal generated at the control unit 218 and then may be driven to discharge during the second phase of a cycle of the periodic signal.

Accordingly the IR LED arrays may be switched between a high power mode (i.e. as the ultracapacitor array 214 discharges into the IR LED array 220) and a low power mode (i.e. as the ultracapacitor array 214 is charged).

Figure 8:
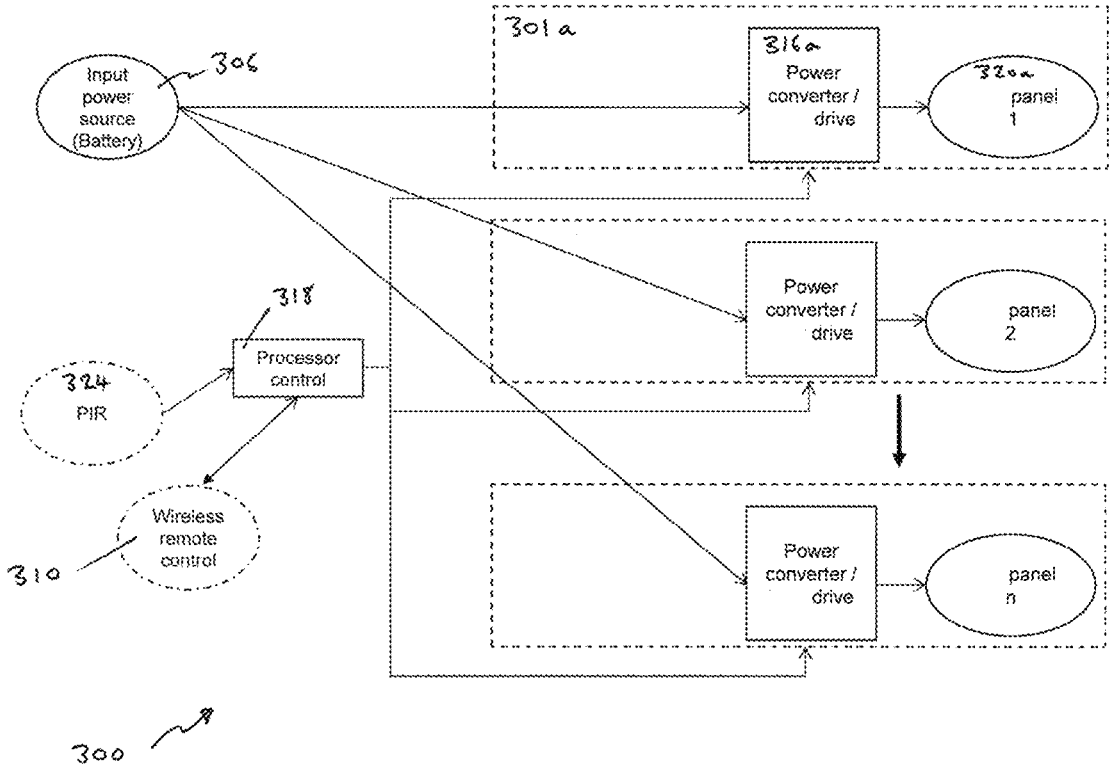
FIG. 8 shows a schematic diagram of a second embodiment of a device according to the present invention.

FIG. 8 shows schematically a device 300, similar to device 100, where components similar to components in device 100 are incremented by 200. For instance the IR LED array 120*a* of the device 100 in FIG. 1 is similar to the IR LED array 320*a* of device 300.

As such, with reference FIG. 8 there is shown generally at 300 a further schematic embodiment of a device. As compared with the FIG. 7 embodiment, this device 300 tends to do away with the ultracapacitor arrays 214*a*, 214*b*, 214*c* and the associated charger 215.

Thus in this FIG. 8 embodiment, the light emission units 301 comprise a power converter unit 316 connected to an IR LED array 320.

A power source 306 is connected to each of the power converters 316*a*, 316*b* and 316*c*. A control unit 318 is connected to each of the power converters 316*a*, 316*b* and 316*c*. The control unit 318 is also connected to various interface units, such as a PIR sensor unit 324 and a wireless control unit 310 (which may be provided as part of a broader operator interface including also a manual remote control unit) such that the control unit 318 may act in dependence on signals received from these.

In operation, the device 300 activates at least one of the IR LED arrays 320*a*, 320*b*, and 320*c* when the associated power converter unit 316*a*, 316*b*, or 316*c* is instructed by a signal from the control unit 318 to pass electrical energy from the power source 306 to its associated IR LED array. With energy being transferred from the power source 306 to an IR LED array 302, the device 300 is placed in a high power mode of operation.

The instruction to pass energy between the power source 306 and some or all of the IR LED arrays 320*a*, 320*b*, 320*c* may be in the form of a periodic signal having a first phase of a cycle and a second phase of a cycle such that the first phase of the cycle causes activation of the IR LED arrays 320*a*, 320*b*, 320*c* (i.e. electrical energy is supplied to the IR LED arrays 320*a*, 320*b*, 320*c*) and the second portion of the cycle causes deactivation (i.e. not electrical energy supplied to the arrays).

In general operation any of the devices 100, 200 or 300 may be used as follows.

An operator firstly identifies an enclosure, particularly a building, or an open area containing targets.

The operator then throws or otherwise deploys the device into the building or open area (having first set the device into the 'on' mode).

The operator then selects that the device be activated. This selection may be by means of an instruction to the device issued, via an operator-held remote control device, to the wireless transceiver. Alternatively this instruction may have been made prior to deployment of the device by setting a countdown timer (using a clock in the control unit) such that at the end of the countdown, the device is activated.

Upon activation the IR LED arrays are illuminated with IR radiation.

The invention claimed is:

1. An IR illumination device, the device comprising:
an electrical power source; and
an array of IR light emitting diodes configured to emit IR radiation in the wavelength range of 750 nm to 900 nm,
wherein the array of IR light emitting diodes is one of a plurality of arrays of IR light emitting diodes,
wherein the device further comprises a plurality of light emission units each connected to the electrical power source independently, and
wherein each of the light emission units comprises:
one of the arrays of IR light emitting diodes, and
a power converter unit for driving the respective array.

2. The device according to claim 1, wherein the wavelength range is from 750 nm to 800 nm.

3. The device according to claim 1, wherein at least one of the arrays comprises at least two different wavelength IR light emitting diodes.

4. The device according to claim 1, further comprising: an operator interface, and a control unit independently connected to each light emission unit, the control unit comprising a processor and being operably connected to the operator interface.

5. The device according to claim 1, wherein each light emission unit comprises a capacitive and/or an inductive energy store.

6. The device according to claim 4, wherein the control unit is configured for driving at least one of the arrays of IR light emitting diodes in a pulse mode when the device is activated such that in operation the at least one of the arrays of IR light emitting diodes switches between a high power output condition and a low power output condition repeatedly.

7. The device according to claim 6, wherein the pulse mode is such that the at least one of the arrays of IR light emitting diodes switches between the high power output condition and the low power output condition at a predetermined frequency.

8. The device according to claim 1, wherein the electrical power source includes a lithium ion battery.

9. The device according to claim 4, wherein the operator interface is configured to enable selection between initiation modes.

10. The device according to claim 9, wherein the initiation modes comprise any combination of: an instant initiation, a delayed initiation, a wirelessly controlled initiation, and/or a mechanical initiation.

11. The device according to claim 9, wherein the operator interface is configured to enable selection between activation modes.

12. The device according to claim 1, wherein the device is a controlled descent payload capable of being launched from a munition.

13. The device of claim 1, further comprising a carrier; a fuze; and a controlled descent payload comprising the array of IR light emitting diodes.

14. An IR illumination munition device, the device comprising:

an electrical power source; and an array of IR light emitting diodes configured to emit IR radiation in the wavelength range of 750 nm to 900 nm, wherein the array of IR light emitting diodes comprises at least two different wavelength IR light emitting diodes.

15. The device according to claim 14, wherein the wavelength range is from 750 nm to 800 nm.

16. The device according to claim 14, wherein the array of IR light emitting diodes is one of a plurality of array of IR light emitting diodes, and wherein device comprises a plurality of light emission units each connected to the electrical power source independently and each of the light emission units comprises:

one of the arrays of IR light emitting diodes, and a power converter unit for driving the array.

17. The device according to claim 16, further comprising: an operator interface, and a control unit independently connected to each of the light emission units, the control unit comprising a processor and being operably connected to the operator interface.

18. The device according to claim 17, wherein the control unit is configured for driving the array of IR light emitting diodes in a pulse mode when the device is activated such that in operation the array of IR light emitting diodes switches between a high power output condition and a low power output condition repeatedly.

19. The device according to claim 18, wherein the pulse mode is such that the array of IR light emitting diodes switches between the high power output condition and the low power output condition at a predetermined frequency.

20. The device according to claim 16, wherein each of the light emission units comprises a capacitive and/or an inductive energy store.

* * * * *